US008727194B2

(12) United States Patent
Hideoka et al.

(10) Patent No.: US 8,727,194 B2
(45) Date of Patent: May 20, 2014

(54) CUTTER BLADE FOR PACKING CONTAINER AND PACKING CONTAINER

(75) Inventors: Makoto Hideoka, Tokyo (JP); Tadashi Umetsu, Tokyo (JP); Asako Saeki, Osaka (JP); Yoshikazu Amano, Tokyo (JP); Makoto Unino, Tokyo (JP); Shinichi Sekine, Tokyo (JP); Kenichi Ishii, Tokyo (JP); Takayuki Seki, Omitama (JP)

(73) Assignee: Kureha Corporation, Chuo-Ku, Tokyo (JP)

( * ) Notice: Subject to any disclaimer, the term of this patent is extended or adjusted under 35 U.S.C. 154(b) by 354 days.

(21) Appl. No.: 12/740,322

(22) PCT Filed: Nov. 26, 2008

(86) PCT No.: PCT/JP2008/071419

§ 371 (c)(1),
(2), (4) Date: Aug. 2, 2010

(87) PCT Pub. No.: WO2009/069639

PCT Pub. Date: Jun. 4, 2009

(65) Prior Publication Data

US 2010/0320250 A1 Dec. 23, 2010

(30) Foreign Application Priority Data

Nov. 29, 2007 (JP) ..... 2007-309300

(51) Int. Cl.

| | |
|---|---|
| ***B26F 3/02*** | (2006.01) |
| ***B65H 35/10*** | (2006.01) |
| ***B26F 3/00*** | (2006.01) |
| ***B65H 35/00*** | (2006.01) |

(52) U.S. Cl.
USPC ..... 225/91; 225/77

(58) Field of Classification Search
USPC ..... 225/91, 77, 33, 39, 43, 56–58
See application file for complete search history.

(56) References Cited

U.S. PATENT DOCUMENTS 1,991,812 A * 2/1935 Marcalus ..... 225/43
4,283,820 A * 8/1981 Willinger ..... 407/29.12

(Continued)

FOREIGN PATENT DOCUMENTS

EP 0352634 1/1990
EP 08853880.6 5/2012

(Continued)

OTHER PUBLICATIONS

International Search Report of International Application No. PCT/JP2008/071419 dated Jan. 20, 2009.

(Continued)

*Primary Examiner* — Ghassem Alie
*Assistant Examiner* — Bharat C Patel
(74) *Attorney, Agent, or Firm* — Workman Nydegger

(57) ABSTRACT

A center portion (30) of a V-shaped cutter blade (20) includes center large teeth (31) and center middle teeth 32 the tooth height of which is less than the tooth height of the center large teeth (31). End portions (50) of the cutter blade (20) each include first end teeth (51) and second end teeth (52) the tooth height of which is less than the tooth height of the first end teeth (51). Tooth tops of the first end teeth 51 of each end portion (50) are located on a straight line (L1), which extends through tooth tops of the center large teeth (31) located on one of the right half and the left half of the center portion (30).

6 Claims, 10 Drawing Sheets

(56) References Cited

U.S. PATENT DOCUMENTS

| | | | | |
|---|---|---|---|---|
| 4,426,029 | A * | 1/1984 | Kamp | 225/49 |
| 4,450,996 | A * | 5/1984 | Kamp | 225/43 |
| 4,586,639 | A * | 5/1986 | Ruff et al. | 225/1 |
| 5,078,311 | A * | 1/1992 | Taguchi et al. | 225/43 |
| 5,423,464 | A * | 6/1995 | Yuki et al. | 225/43 |
| 5,511,663 | A * | 4/1996 | Shimura et al. | 206/395 |
| 6,173,876 | B1 * | 1/2001 | Sano et al. | 225/39 |
| 6,375,058 | B1 * | 4/2002 | Passamoni | 225/49 |
| 6,405,913 | B1 * | 6/2002 | Passamoni | 225/43 |
| 6,520,395 | B1 * | 2/2003 | Takayama | 225/41 |
| 6,682,808 | B2 * | 1/2004 | Kobayashi et al. | 428/213 |
| 7,160,237 | B2 * | 1/2007 | Hashimoto et al. | 493/356 |
| 2003/0132262 | A1 * | 7/2003 | Takayama | 225/43 |

FOREIGN PATENT DOCUMENTS

| | | |
|---|---|---|
| JP | 4-132028 | 12/1992 |
| JP | 05-147646 | 6/1993 |
| JP | 05-178344 | 7/1993 |
| JP | 05-229552 | 9/1993 |
| JP | 6-20224 | 3/1994 |
| JP | 6-42653 | 6/1994 |
| JP | 7-11527 | 2/1995 |
| JP | 08-026264 | 1/1996 |
| JP | 08-040433 | 2/1996 |
| JP | 8-694 | 4/1996 |
| JP | 9-077055 | 3/1997 |
| JP | 2547868 | 9/1997 |
| JP | 11-099498 | 4/1999 |
| JP | 11-151 | 11/1999 |
| JP | 2000-190957 | 7/2000 |
| JP | 2006-021292 | 1/2006 |
| TW | M253588 | 12/2004 |
| TW | 200934697 | 9/2012 |

OTHER PUBLICATIONS

International Search Report for corresponding International Application No. PCT/JP2008/071419 dated Jun. 8, 2010.

* cited by examiner

CUTTER BLADE FOR PACKING CONTAINER AND PACKING CONTAINER

FIELD OF THE INVENTION

The present invention relates to a cutter blade for packing container and a packing container.

BACKGROUND OF THE INVENTION

A packing container for cling film includes a container main body made of cardboard for accommodating rolled cling film, a lid body integrally formed with the container main body, and a sawtooth cutter blade attached to the lid body for cutting the cling film.

It has been proposed to use a cutter blade that has a V-shaped configuration, in which the center portion is closer to the bottom of the packing container than the end portions, instead of a cutter blade that has a straight configuration, in which the cutter blade extends in the axial direction of rolled cling film. When starting to cut cling film using a V-shaped cutter blade from a portion of the cutter blade that corresponds to the vertex of the V, the cling film is reliably and easily cut.

Also, metal cutter blades have been conventionally used from the standpoint of improving cutting performance and durability. However, taking into account the influence on environment, the use of non-metallic cutter blades such as those made of paper and resin have been considered for example, Patent Document 1).

Non-metallic cutter blades generally have less efficient cutting performance as compared to metal cutter blades. Thus, relatively great force is required for cutting when a non-metallic cutter blade is used to cut highly stretchable cling film that is made of, for example, polyethylene, polypropylene, and polyvinylidene chloride. There thus exists a serious need for improving the cutting performance of non-metallic cutter blades.

Patent Document 2 and Patent Document 3 each disclose a straight cutter blade in which the tooth tops of the teeth located at the end portions of the cutter blade are formed to face outward to facilitate piercing of the teeth into cling film. Patent Document 4 and Patent Document 5 each disclose a V-shaped cutter blade in which the size of the teeth located at the center portion of the cutter blade is relatively enlarged to facilitate piercing of the teeth into cling film during initial cutting of the cling film. Patent Document 6 discloses a reverse V-shaped cutter blade in which the tooth tops of the teeth located at the end portions of the cutter blade are formed to face inward to facilitate piercing of the teeth into cling film.

A method for cutting cling film by a cutter blade varies in accordance with the shape of the cutter blade. For example, when using a V-shaped cutter blade, the center portion of the cutter blade is pressed against approximately the widthwise center of cling film that is drawn out of the packing container by a desired length. Then, the teeth located at the center portion of the cutter blade pierce approximately the widthwise center of the cling film. Subsequently, the packing container is twisted to cut the cling film.

When using a straight or reverse V-shaped cutter blade, one of the end portions of the cutter blade is pressed against the corresponding one of the widthwise ends of cling film drawn out of the packing container by a desired length. Then, the teeth located at the end portion of the cutter blade pierce the widthwise end of the cling film. Subsequently, the distal end of the drawn out cling film is lifted to cut the cling film.

Patent Document 1: Japanese Patent No. 3573605
Patent Document 2: Japanese Laid-Open Utility Model Publication No. 6-20224
Patent Document 3: Japanese Laid-Open Utility Model Publication No. 11-151
Patent Document 4: Registered Utility Model No. 2547868
Patent Document 5: Japanese Laid-Open Patent Publication No. 5-178344
Patent Document 6: Japanese Laid-Open Patent Publication No. 8-40433

SUMMARY OF THE INVENTION

While studying the shapes of cutter blades, the present inventors found that cutting of cling film by a straight cutter blade was not smooth after causing teeth of the cutter blade to pierce the cling film as compared to the case in which a V-shaped cutter blade was used.

Also, even if a packing container for cling film employs a V-shaped cutter blade, a user does not always check whether the cutter blade is V-shaped, and the user might not cut the cling film by the method suitable for the V-shaped cutter blade. According to the experiments of the present inventors, it was difficult to cut cling film in a satisfactory manner when starting to cut the cling film from one of the end portions of a V-shaped cutter blade.

Accordingly, it is an objective of the present invention to provide a highly durable cutter blade that reliably cuts packing material in either cases where the tooth located at the center portion of the cutter blade or the tooth located on one of the end portions of the cutter blade first pierces the packing material such as cling film to cut the packing material, and to provide a packing container that includes the cutter blade.

To achieve the above objective, one aspect of the present invention provides a non-metallic V-shaped cutter blade that is used by being attached to a packing container accommodating rolled packing material to cut the packing material. The cutter blade includes a center portion including a vertex of the V, a pair of end portions each including one of ends of the V, and a pair of middle portions each located between one of the end portions and the center portion. The center portion includes first center teeth and second center teeth. The tooth height of the second center teeth is less than the tooth height of the first center teeth. The first center teeth are arranged such that the distance between adjacent first center teeth is constant. One of the first center teeth located at the center is located at the vertex of the V. The second center teeth are each located between adjacent two of the first center teeth. A first tooth top line connecting tooth tops of the first center teeth, a second tooth top line connecting tooth tops of the second center teeth, and a tooth root line connecting roots of the first center teeth and roots of the second center teeth are parallel to one another. The second tooth top line is located between the first tooth top line and the tooth root line. The middle portions each include middle teeth. Tooth tops of the middle teeth are located on the second tooth top line or between the second tooth top line and the tooth root line. The end portions each include first end teeth. The first end teeth are located to overlap the first tooth top line.

According to another aspect of the present invention, a packing container for accommodating rolled packing material is provided. The packing container includes the above-mentioned cutter blade to cut the packing material.

DETAILED DESCRIPTION OF THE PREFERRED EMBODIMENTS

First Embodiment

Figure 1:
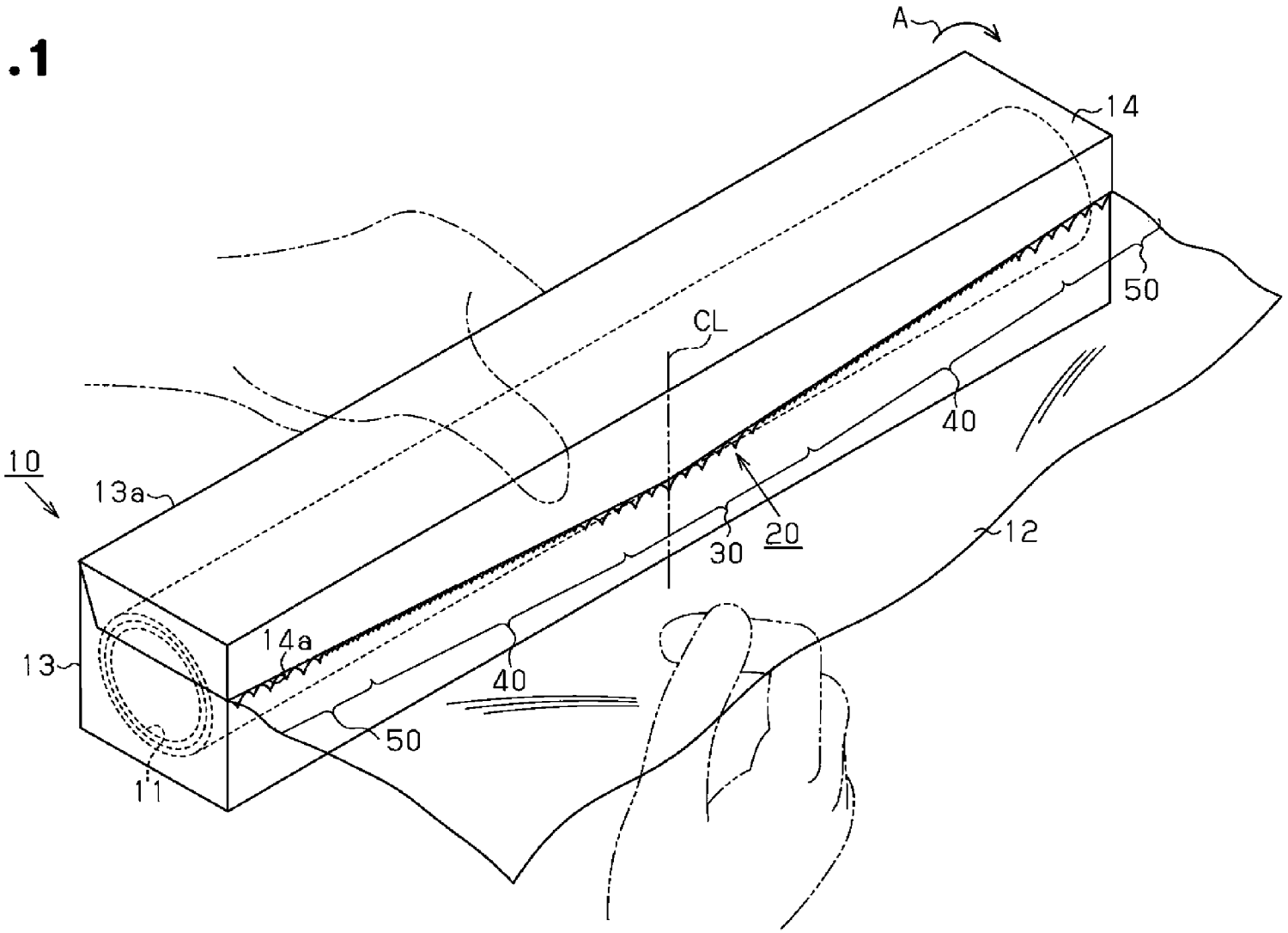
FIG. 1 is a perspective view illustrating a packing container according to a first embodiment of the present invention, showing the manner in which the packing container is used.

A first embodiment of the present invention will now be described with reference to FIGS. 1 to 6. As shown in FIG. 1, a packing container 10 of the first embodiment includes a container main body 13 and a lid body 14 integrally formed with the container main body 13. The container main body 13 accommodates rolled cling film 12 wound around a cylindrical paper core 11. The packing container 10 is formed of a sheet of cardboard, and preferably made of a coated cardboard.

The container main body 13 is a box with a top opening, and the cling film 12 is drawn out from the top of the container main body 13. The lid body 14 extends from an upper edge 13*a* of the rear wall of the container main body 13, and covers the entire opening of the container main body 13. The lid body 14 selectively opens and closes the opening of the container main body 13. A lower edge 14*a* of the front wall of the lid body 14 is V-shaped. A V-shaped cutter blade 20, which extends along the lower edge 14*a*, is attached to the back surface of the front wall of the lid body 14. The packing container 10 has a substantially rectangular parallelepiped shape when the lid body 14 is closed. The cling film 12 is drawn out of the packing container 10 with the lid body 14 open. The cling film 12 is made of, for example, polyvinylidene chloride.

When cutting the cling film 12 from its widthwise center, a user grasps the distal end of the cling film 12 with one hand, and holds the packing container 10 with the other hand. Then, the user twists the packing container 10 forward, that is, in the direction of arrow A in FIG. 1 while pressing the center part of the front wall of the lid body 14 with the thumb of the hand holding the packing container 10. Thus, the teeth located at the center portion of the cutter blade 20 first pierce the cling film 12. Then, the cling film 12 is cut by further twisting the packing container 10.

When cutting the cling film 12 from one of its widthwise ends, for example, when cutting from the right end in FIG. 1, the user grasps the distal end of the cling film 12 at the rightward section with one hand, and holds the packing container 10 with the other hand. Then, while pressing the lid body 14 with the hand holding the packing container, the user lifts the cling film 12 grasped in the other hand. Thus, the teeth located at the right end portion of the cutter blade 20 first pierce the cling film 12. Subsequently, the cling film 12 is cut by further lifting the cling film 12.

Figure 2:
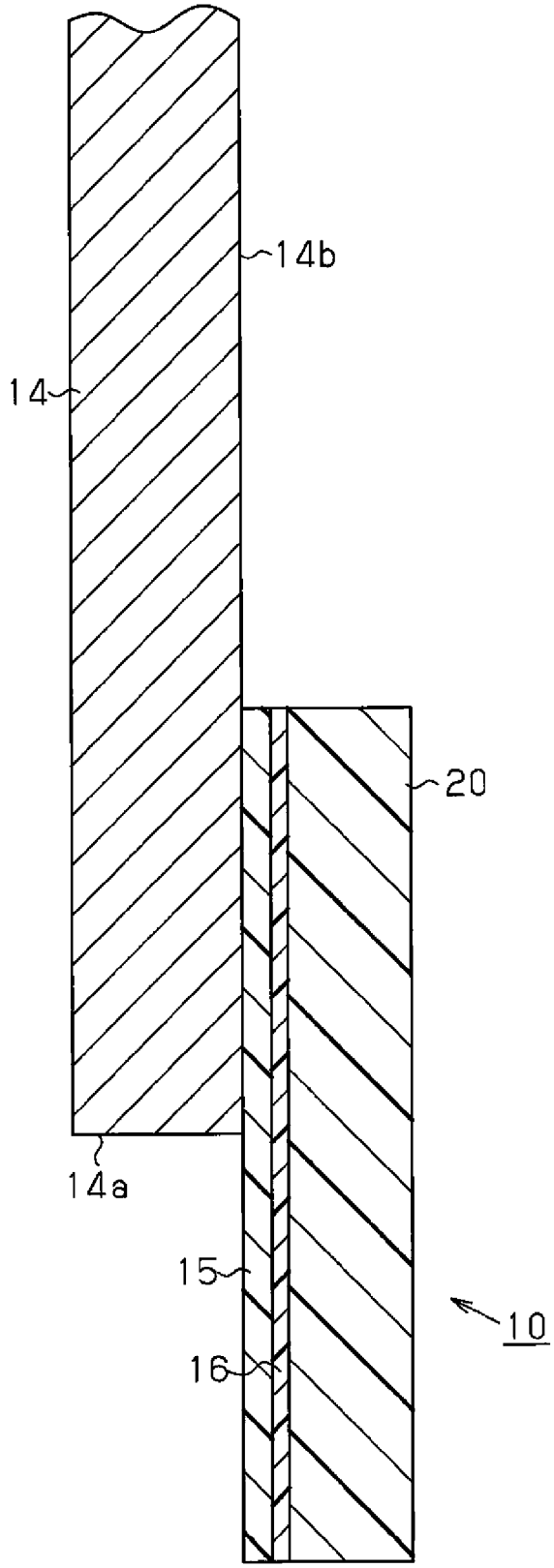
FIG. 2 is a cross-sectional view illustrating part of the packing container of FIG. 1.

As shown in FIG. 2 illustrating the lower edge 14*a* of the lid body 14 and its vicinity, a sealant material 15 and an adhesion layer 16 are provided between a back surface 14*b* of the front wall of the lid body 14 and the cutter blade 20. The cutter blade 20 is adhered to the sealant material 15 formed mainly of, for example, an ethylene-methacrylic acid copolymer by, for example, the adhesion layer 16 formed of a polyurethane adhesive. The sealant material 15 is adhered to the back surface 14*b* of the lid body 11 by ultrasonic bonding. The cutter blade 20 is attached to the lid body 14 via the sealant material 15 and the adhesion layer 16 with a sufficient strength that the cutter blade 20 does not easily fall off the lid body 14.

Figure 3:
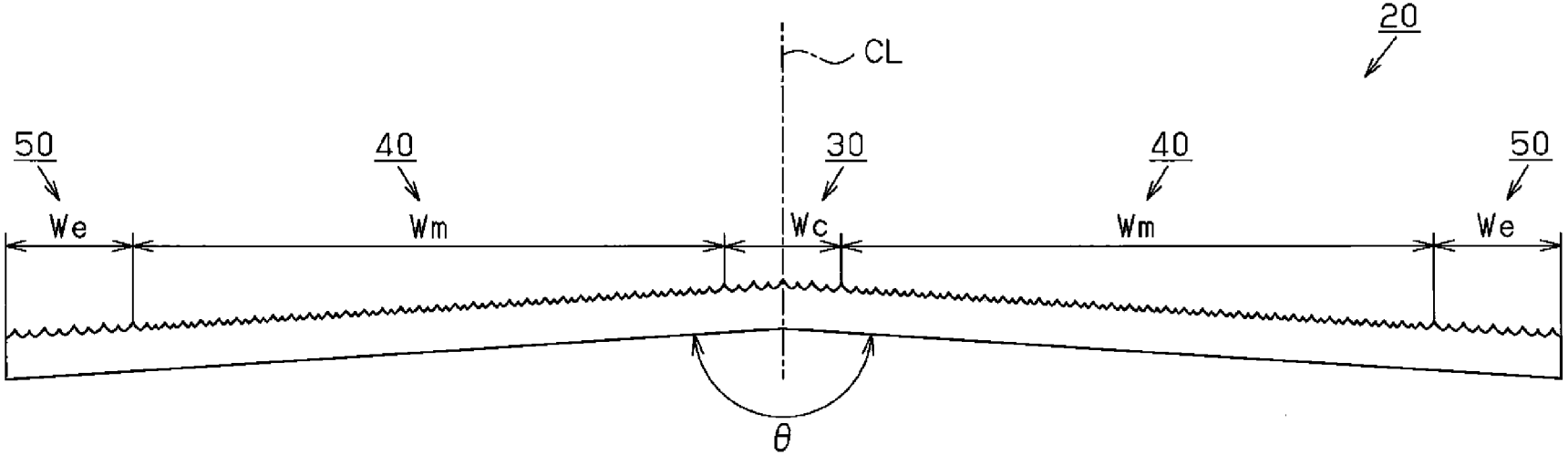
FIG. 3 is a front view illustrating the cutter blade of the packing container of FIG. 1.

The cutter blade 20 will be described below in detail. As shown in FIG. 3 illustrating the entire cutter blade 20, the cutter blade 20 is symmetrical with respect to a center line CL, which extends through the vertex of the V defined by the outer shape of the cutter blade 20 (that is, the cutter blade 20 is symmetrical along the longitudinal direction of the packing container 10). The cutter blade 20 includes a center portion 30, which includes the vertex of the V, a pair of middle portions 40 located on both sides of the center portion 30, and a pair of end portions 50, each of which includes one of the ends of the V.

The inner angle θ of the V of the cutter blade 20 is, for example, 172.5°. When the width (entire length) of the cutter blade 20 in the right-left direction is 304 mm, the width Wc of the center portion 30 is, for example, 36.6 mm, the width Wm of the middle portions 40 is, for example, 116.5 mm, and the width We of the end portions 50 is, for example, 17.2 mm. When the width (entire length) of the cutter blade 20 in the right-left direction is 222 mm, the width Wc of the center portion 30 is, for example, 36.6 mm, the width Wm of the middle portions 40 is, for example, 75.5 mm, and the width We of the end portions 50 is, for example, 17.2 mm.

The cutter blade 20 is made of non-metallic material and may be made of, for example, resin. The example of resin for forming the cutter blade 20 includes, a polyethylene-based resin, a polypropylene-based resin, an acrylic-based resin, a polyester-based resin, a polyethylene terephthalate (PET)-based resin, a polyvinyl chloride-based resin, a polyphenylene sulfide-based resin, a polyacetal-based resin, a polylactic acid-based resin, a polyglycolic acid-based resin, an epoxy-based resin, and a phenolic-based resin. Among these, the PET-based resin, the polylactic acid-based resin, and the polyglycolic acid-based resin are preferred that are thermoplastic and are easily machined, and have practically sufficient hardness and strength. To give special consideration to environment, a biodegradable resin is preferred. The representative example of the biodegradable resin includes a polylactic acid and a polyglycolic acid. In the present invention, a cutter blade formed by biaxially stretching a polylactic acid-based resin composition disclosed in Patent Document 1 is used in a suitable manner. More specifically, the cutter blade 20 may be obtained by forming teeth on a sheet obtained by biaxially stretching a polylactic acid-based resin composition by, for example, pressing and laser cutting. The cutter blade 20 may include an inorganic filler disclosed in Patent Document 1 in addition to resin, and may further include a heat stabilizer, a light stabilizer, a waterproof material, a mold release agent, a pigment, or a dye.

Figure 4:
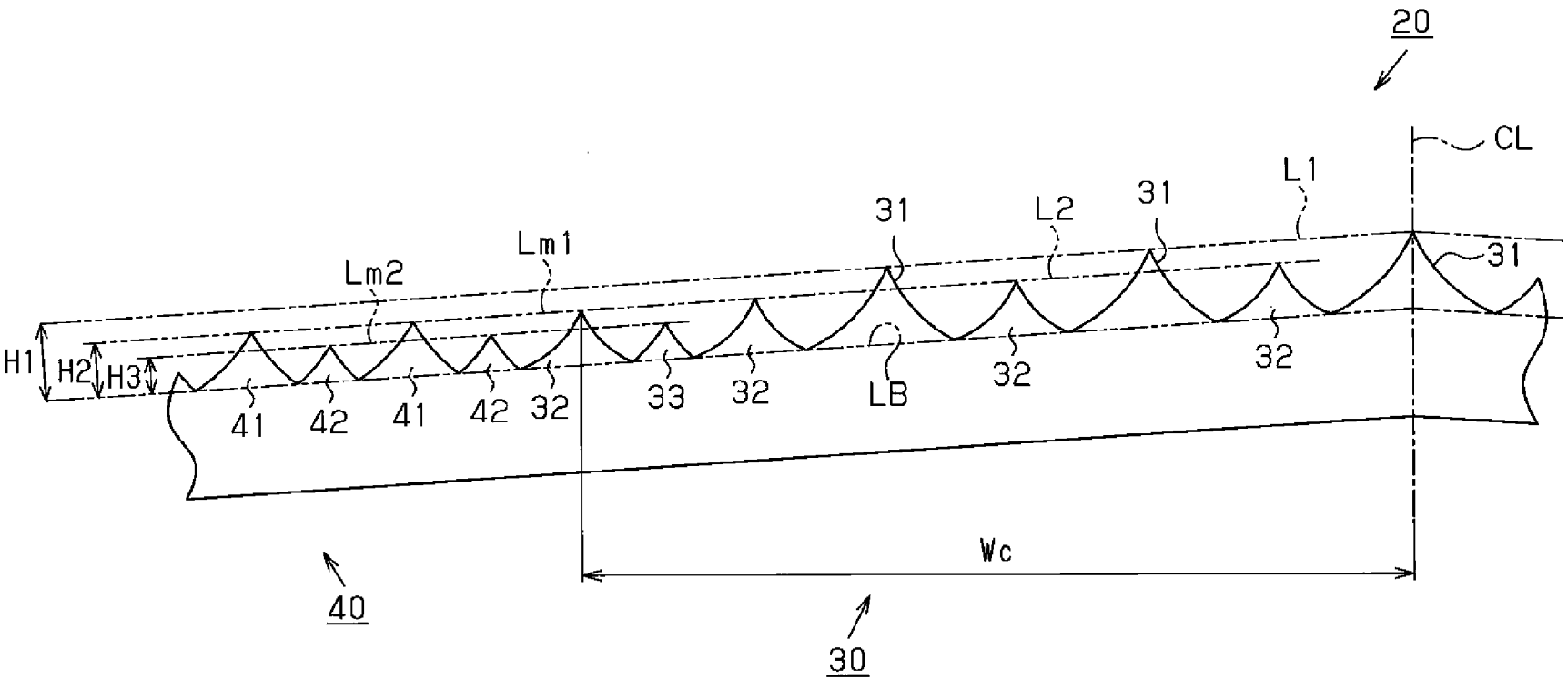
FIG. 4 is an enlarged view illustrating part of FIG. 3.

As shown in FIG. 4, the center portion 30 of the cutter blade 20 includes first center teeth, which are center large teeth 31, second center teeth, which are center middle teeth 32, and third center teeth, which are center small teeth 33. In FIG. 4 illustrating the center portion 30 and middle portion 40 on the left half of the left-right symmetric cutter blade 20, three of the center large teeth 31, four of the center middle teeth 32, and one of the center small teeth 33 are shown. The roots of the center large teeth 31, the center middle teeth 32, and the center small tooth 33 located on the left half of the center portion 30 and the roots of those on the right half of the center portion 30 are respectively arranged on a single reference straight line LB. The shortest distance between the distal end of each tooth and the corresponding reference straight line LB, that is, the distance between the roots and the tooth top of each tooth is referred to as the tooth height.

The tooth height H1 of the center large teeth 31 is greater than the tooth height H2 of the center middle teeth 32. The center large teeth 31 are arranged such that the distance between the adjacent center large teeth 31 is constant. One of the center large teeth 31 is located at the vertex of the V of the cutter blade 20. The tooth tops of the center large teeth 31 located on the left half of the center portion 30 and the tooth tops of those on the right half of the center portion 30 are respectively located on a single first center tooth top straight line L1. Each first center tooth top straight line L1 is substantially parallel to the corresponding reference straight line LB.

The tooth height H2 of the center middle teeth 32 is greater than the tooth height H3 of the center small teeth 33. The center middle teeth 32 that are located close to the vertex of the V of the cutter blade 20, which include two of the center middle teeth 32 shown in FIG. 4 that are located close to the vertex of the V, are each located between the corresponding adjacent pair of center large teeth 31. The tooth tops of the center middle teeth 32 located on the left half of the center portion 30 and the tooth tops of those on the right half of the center portion 30 are respectively located on a single second center tooth top straight line L2. Each second center tooth top straight line L2 is substantially parallel to the corresponding reference straight line LB, and is located between the reference straight line LB and the corresponding first center tooth top straight line L1.

The tooth height H3 of the center small teeth 33 is less than the tooth height H2 of the center middle teeth 32. Each of the center small teeth 33 is located between two center middle teeth 32 located away from the vertex of the V of the cutter blade 20 among the center middle teeth 32 located on the corresponding one of the left half and the right half of the center portion 30. The center small teeth 33 contributes to smooth transition of the piercing of the teeth of the cutter blade 20 into the cling film 12 and subsequent cutting from the center portion 30 of the cutter blade 20 to the middle portions 40.

The middle portions 40 of the cutter blade 20 each include first middle teeth 41 and second middle teeth 42, each of which is located between adjacent pair of the first middle teeth 41. The roots of the first middle teeth 41 and the second middle teeth 42 of each middle portion 40 are located on the corresponding reference straight line LB.

The tooth tops of the first middle teeth 41 of each middle portion 40 are located on a single first middle tooth top straight line Lm1. Each first middle tooth top straight line Lm1 is located on an extension line of the corresponding second center tooth top straight line L2. More specifically, each first middle tooth top straight line Lm1 is a straight line that is the same as the corresponding second center tooth top straight line L2. The tooth height of the first middle teeth 41 is equal to the tooth height H2 of the center middle teeth 32.

However, the tooth height of the first middle teeth 41 does not need to be equal to the tooth height H2 of the center middle teeth 32, but may be, for example, less than the tooth height H2. Also, each first middle tooth top straight line Lm1 does not need to be located on an extension line of the corresponding second center tooth top straight line L2, but may be, for example, substantially parallel to the corresponding reference straight line LB and located between the reference straight line LB and the corresponding second center tooth top straight line L2.

The tooth tops of the second middle teeth 42 of each middle portion 40 are located on a single second middle tooth top straight line Lm2. Each second middle tooth top straight line Lm2 passes through the tooth top of the corresponding center small tooth 33. The tooth height of the second middle teeth 42 is equal to the tooth height H3 of the center small tooth 33.

However, the tooth height of the second middle teeth 42 does not need to be equal to the tooth height H3 of the center small tooth 33, but may be, for example, less than the tooth height H3. Also, each second middle tooth top straight line Lm2 does not need to pass through the tooth top of the corresponding center small tooth 33 but may be, for example, substantially parallel to the corresponding reference straight line LB and pass between the roots and the tooth top of the corresponding center small tooth 33.

Figure 5:
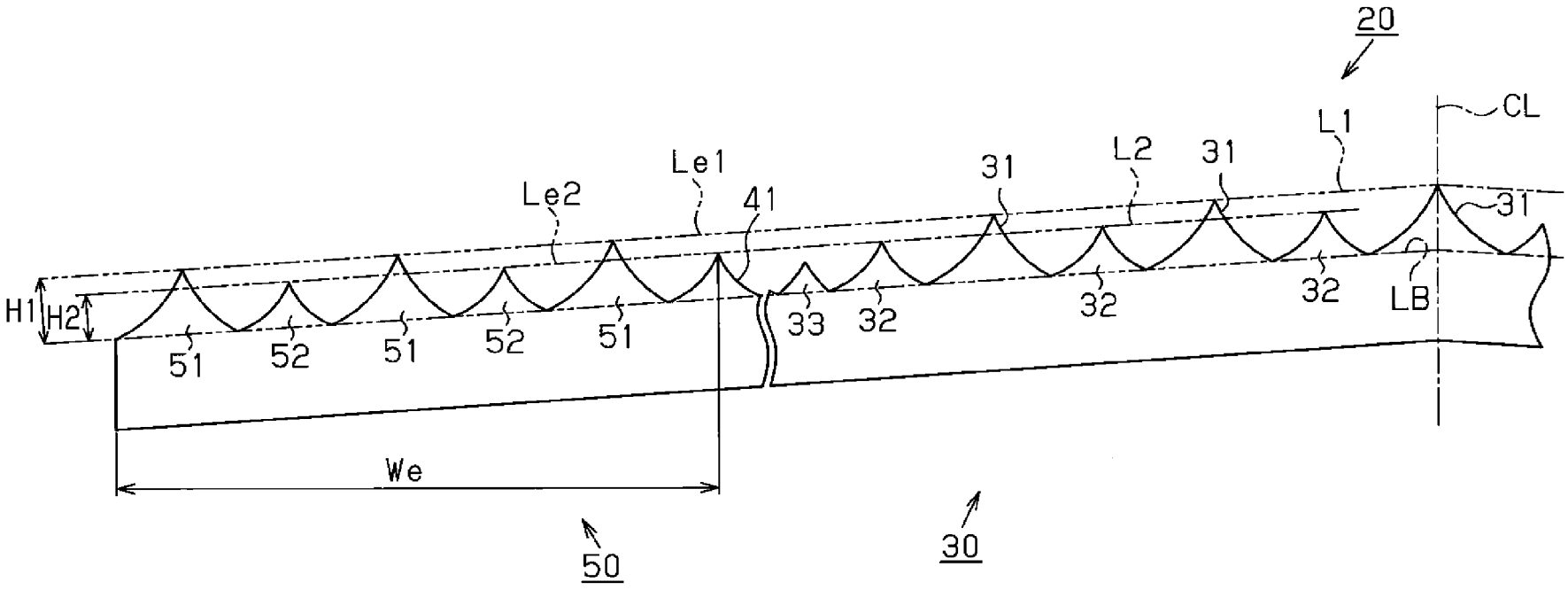
FIG. 5 is an enlarged view illustrating a different part of FIG. 3.

As shown in FIG. 5, each end portion 50 of the cutter blade 20 includes first end teeth 51 (for example, five first end teeth 51) and second end teeth 52 each located between adjacent pair of the first end teeth 51. The roots of the first end teeth 51 and the second end teeth 52 of each end portion 50 are located on the corresponding reference straight line LB. The number of the first end teeth 51 and the second end teeth 52 shown in FIG. 5 illustrating the center portion 30 and the end portion 50 on the left half of the cutter blade 20 is less than the actual number for purposes of illustration.

The tooth tops of the first end teeth 51 of each end portion 50 are located on a single first end tooth top straight line Le1. Each first end tooth top straight line Le1 is located on an extension line of the corresponding first center tooth top straight line L1. More specifically, the first end tooth top straight line Le1 is a straight line that is the same as the corresponding first center tooth top straight line L1. The tooth height of the first end teeth 51 is equal to the tooth height H1 of the center large teeth 31.

However, the tooth height of the first end teeth 51 does not need to be equal to the tooth height H1 of the center large teeth 31, but may be, for example, greater than the tooth height H1. Also, each first end tooth top straight line Le1 does not need to be located on an extension line of the corresponding first center tooth top straight line L1, but may be, for example, substantially parallel to the corresponding reference straight line LB and pass through a position above the tooth tops of the corresponding center large teeth 31. That is, the first end teeth 51 of each end portion 50 may have any height as long as the first end teeth 51 are located to overlap the corresponding first center tooth top straight line L1.

The tooth tops of the second end teeth 52 of each end portion 50 are located on a single second end tooth top straight line Le2. Each second end tooth top straight line Le2 is located on an extension line of the corresponding second center tooth top straight line L2. More specifically, each second end tooth top straight line Le2 is a straight line that is the same as the corresponding second center tooth top straight line L2. The tooth height of the second end teeth 52 is equal to the tooth height H2 of the center middle teeth 32.

However, the tooth height of the second end teeth 52 does not need to be equal to the tooth height H2 of the center middle teeth 32 as long as, for example, the tooth height of the second end teeth 52 is less than the tooth height H1 of the center large teeth 31. Also, each second end tooth top straight line Le2 does not need to be located on an extension line of the corresponding second center tooth top straight line L2 as long as, for example, the second end tooth top straight line Le2 is substantially parallel to the corresponding reference straight line LB and is located between the corresponding reference straight line LB and first end tooth top straight line Le1.

Two methods for cutting the cling film 12 using the packing container 10 will now be described.

First, a first cutting method started by causing the teeth of the center portion 30 of the cutter blade 20 to pierce the cling film 12 is as follows.

The user holds the packing container 10 with one hand, and grasps the distal end of the cling film 12 with the other hand as shown in FIG. 1. After drawing out the desired length of the cling film from the container main body 13, the user twists the packing container 10 forward, that is, in the direction of arrow A in FIG. 1 while pressing the center portion of the front wall of the lid body 14 with the thumb of the hand holding the packing container 10. Then, the center large tooth 31 located at the vertex of the V of the cutter blade 20 first contacts and pierces the cling film 12, and the remaining center large teeth 31 contact and pierce the cling film 12 in order from the one closer to the vertex of the V. The center large teeth 31 piercing the cling film 12 in this manner further deeply pierce the cling film 12 so that cutting of the cling film 12 is started.

The force required to cause the center large teeth 31 to pierce the cling film 12 is increased as the number of the center large teeth 31 that simultaneously pierce the cling film 12 is increased. In the packing container 10 of the present embodiment, the number of the center large teeth 31 simultaneously piercing the cling film 12 is small since the center large tooth 31 located at the vertex of the V of the cutter blade 20 first contacts and pierces the cling film 12, and the remaining center large teeth 31 subsequently contact and pierce the cling film 12 in order from the one close to the vertex of the V as the packing container 10 is twisted in the direction of arrow A. Thus, the force required to cause the center large teeth 31 to pierce the cling film 12 is small. This improves the cutting feel of the user during the initial cutting of the cling film 12. Furthermore, since the width of the roots of the center large teeth 31 is relatively large, the center large teeth 31 have high mechanical endurance as compared to teeth having narrow roots. Thus, the center portion 30 of the cutter blade 20 has high mechanical endurance by a level corresponding to the number of the center large teeth 31.

By further twisting the packing container 10 in the direction of arrow A after the piercing of the center large teeth 31 into the cling film 12 is started, the center middle teeth 32 first contact and pierce the cling film 12 in order from the one closer to the vertex of the V of the cutter blade 20, and the center small teeth 33 subsequently contact and pierce the cling film 12. If the center middle teeth 32 are omitted, great resistance to the cutting of the cling film 12 is generated between the adjacent pair of the center large teeth 31 since the width of the roots of the center large teeth 31 is large, which increases the force required to cut the cling film 12. In contrast, each of the center middle teeth 32 located between the corresponding adjacent pair of center large teeth 31 significantly reduces such resistance in the packing container 10 of the present embodiment. Also, each of the center small teeth 33 reduces resistance to the cutting of the cling film 12 generated between the corresponding adjacent pair of center middle teeth 32. Moreover, the force required to cause the center middle teeth 32 and the center small teeth 33 to pierce the cling film 12 is less than the force required to cause the center large teeth 31 to pierce the cling film 12 since the cling film 12 has been weakened by the previous piercing of the center large teeth 31. Thus, cutting of the cling film 12 by the center portion 30 of the cutter blade 20 proceeds in a suitable manner.

By further twisting the packing container 10 in the direction of arrow A after cutting the cling film 12 by the center portion 30, the first middle teeth 41 of the middle portions 40 first contact and pierce the cling film 12, and the second middle teeth 42 subsequently contact and pierce the cling film 12. The cling film 12 is cut by the middle portions 4C of the cutter blade 20 in this manner. At this time, since the center small teeth 33 having the tooth height H3 that is equal to the height of the first middle teeth 41 are located on the left and right ends of the center portion 30, transition smoothly proceeds from the cutting of the cling film 12 by the center portion 30 of the cutter blade 20 to the cutting of the cling film 12 by the middle portions 40 of the cutter blade 20. Also, since the cling film 12 is cut by the center portion 30, the subsequent cutting of the cling film 12 by the middle portions 40 does not require very great force.

By further twisting the packing container 10 in the direction of arrow A after cutting the cling film 12 by the middle portions 40, the first end teeth 51 of the end portions 50 first contact and pierce the cling film 12, and the second end teeth 52 subsequently contact and pierce the cling film 12. The cling film 12 is cut by the end portions 50 of the cutter blade 20 in this manner, and as a result, the cling film 12 is cut along the entire width.

Next, a second cutting method started by first causing the teeth of one of the end portions 50 of the cutter blade 20, for example, the teeth of the end portion 50 on the right side to pierce the cling film 12 is described below.

Figure 6:
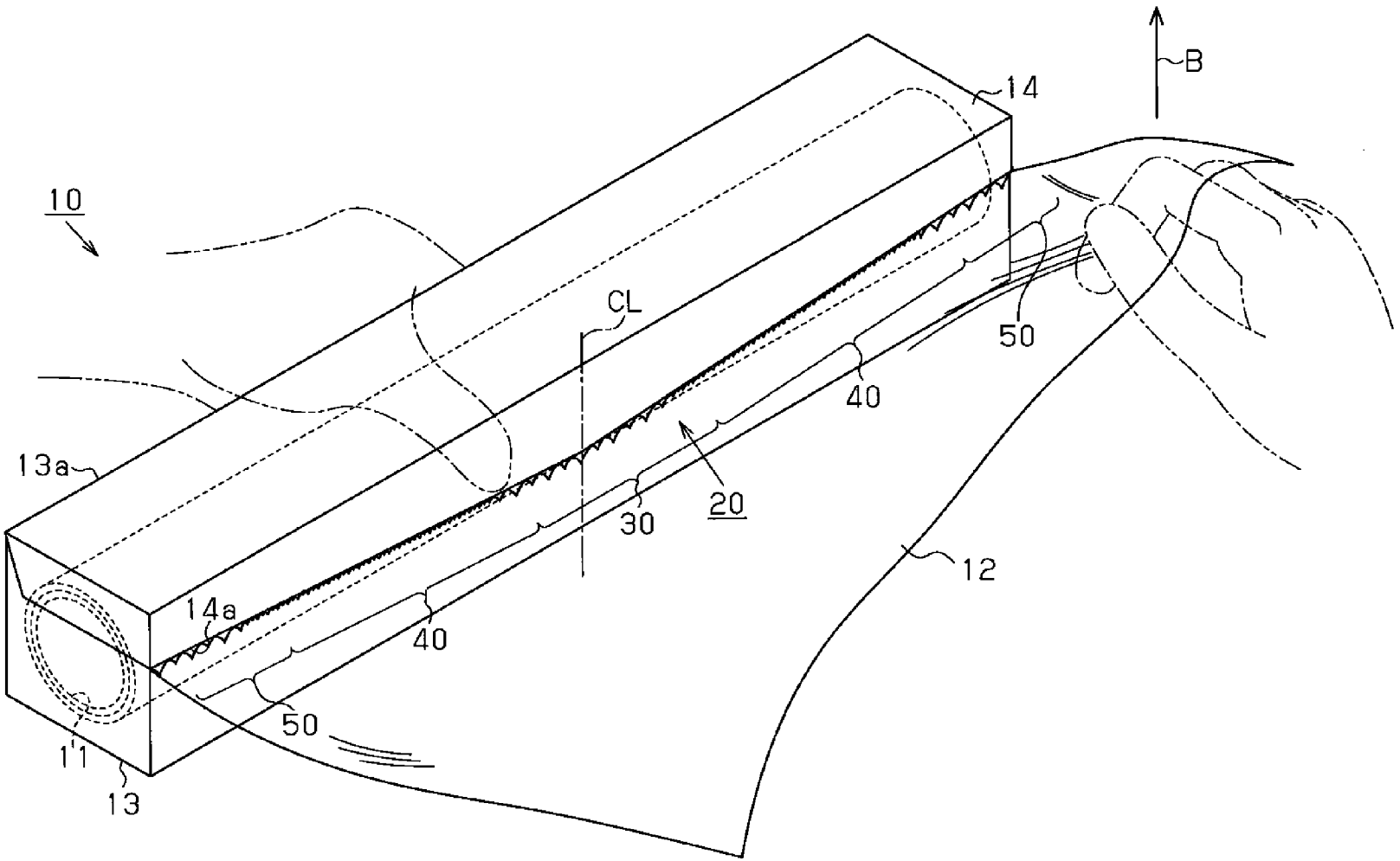
FIG. 6 is a perspective view illustrating the packing container of FIG. 1, showing a different manner in which the packing container is used.

The user holds the packing container 10 with one hand, and grasps the distal end of the cling film 12 with the other hand as shown in FIG. 6. After drawing out the desired length of the cling film from the container main body 13, the user lifts the drawn out cling film 12 upward, that is, in the direction of arrow B while pressing the front wall of the lid body 14 by the hand holding the packing container 10. Then, the first end tooth 51 located on the right end of the cutter blade 20 first contacts and pierces the cling film 12, and the remaining first end teeth 51 located on the right end portion 50 subsequently contact and pierce the cling film 12 in order from the right. The first end teeth 51 piercing the cling film 12 in this manner further pierce the cling film 12 so that cutting of the cling film 12 is started.

The force required to cause the first end teeth 51 to pierce the cling film 12 is increased as the number of the first end teeth 51 simultaneously piercing the cling film 12 is increased. In the packing container 10 of the present embodiment, the number of the first end teeth 51 simultaneously piercing the cling film 12 is minimum since the first end teeth 51 contact and pierce the cling film 12 in order form the right as the drawn out cling film 12 is lifted in the direction of arrow B. Thus, the force required to cause the first end teeth 51 to pierce the cling film 12 is small. This improves the cutting feel of the user at the initial cutting of the cling film 12. Furthermore, the first end teeth 51 have high mechanical endurance as compared to teeth having narrow roots since the width of the roots of the first end teeth 51 is relatively large. Therefore, the end portions of the cutter blade 20 have high mechanical endurance by a level corresponding to the number of the first end teeth 51.

By further lifting the drawn out cling film 12 in the direction of arrow B after piercing of the first end teeth 51 into the cling film 12 is started, the second end teeth 52 located on the right end portion 50 contact and pierce the cling film 12 in order from the right. If the second end teeth 52 are omitted, great resistance to the cutting of the cling film 12 is generated between the adjacent pair of the first end teeth 51 since the width of the roots of the first end teeth 51 is large, which increases the force required to cut the cling film 12. In contrast, each of the second end teeth 52 located between the corresponding adjacent pair of first end teeth 51 significantly reduces such resistance in the packing container 10 of the present embodiment. Moreover, the force required to cause the second end teeth 52 to pierce the cling film 12 is less than the force required to cause the first end teeth 51 to pierce the cling film 12 since the cling film 12 has been weakened by the previous piercing of the first end teeth 51. Thus, cutting of the cling film 12 by the right end portion 50 of the cutter blade 2D proceeds in a suitable manner.

By further lifting the drawn out cling film 12 in the direction of arrow B after cutting the cling film 12 by the right end portion 50, the first middle teeth 41 located on the right middle portion 40 first contact and pierce the cling film 12, and the second middle teeth 42 located on the right middle portion 40 subsequently contact and pierce the cling film 12. The cling film 12 is cut by the right middle portion 4D of the cutter blade 20 in this manner. At this time, since the tooth height of the second end teeth 52 is equal to the tooth height of the first middle teeth 41, transition smoothly proceeds from the cutting of the cling film 12 by the right end portion 50 of the cutter blade 20 to the cutting of the cling film 12 by the right middle portion 40 of the cutter blade 20. Also, since the cling film 12 is cut by the right end portion 50, the subsequent cutting of the cling film 12 by the right middle portion 40 does not require very great force.

By further lifting the drawn out cling film 12 in the direction of arrow B after cutting the cling film 12 by the right middle portion 40, the center large teeth 31 located at the center portion 30 of the cutter blade 20 first contact and pierce the cling film 12, and the center middle teeth 32 and the center small teeth 33 subsequently contact and pierce the cling film 12. The cling film 12 is cut by the center portion 30 of the cutter blade 20 in this manner.

By further lifting the drawn out cling film 12 in the direction of arrow B after cutting the cling film 12 by the center portion 30, the first middle teeth 41 located on the left middle portion 40 first contact and pierce the cling film 12, and the second middle teeth 42 located on the left middle portion 40 subsequently contact and pierce the cling film 12. The cling film 12 is cut by the left middle portion 40 of the cutter blade 20 in this manner. At this time, since the center small tooth 33 having the tooth height H3 that is equal to the height of the first middle teeth 41 is provided on the left end of the center portion 30, transition smoothly proceeds from the cutting of the cling film 12 by the center portion 30 of the cutter blade 20 to the cutting of the cling film 12 by the left middle portion 40 of the cutter blade 20.

By further lifting the drawn out cling film 12 in the direction of arrow B after cutting the cling film 12 by the left middle portion 40 of the cutter blade 20, the first end teeth 51 located on the left end portion 50 first contact and pierce the cling film 12, and the second end teeth 52 located on the left end portion 50 subsequently contact and pierce the cling film 12. The cling film 12 is cut by the left end portion 50 of the cutter blade 20 in this manner, and as a result, the cling film 12 is cut along the entire width.

If the tooth height of the center large teeth 31 or the first end teeth 51 is excessively great as compared to the tooth height of the other teeth, the mechanical strength might be reduced, thus reducing the durability. Also, if the pitch between the center large teeth 31 or the first end teeth 51 is excessively great as compared to the pitch between the other teeth, the cling film 12 might get caught between the teeth, which hinders cutting of the cling film 12. In contrast, if the pitch of the center large teeth 31 or the first end teeth 51 is excessively small as compared to the pitch of the other teeth, the number of teeth is increased and the force required to cause the teeth to pierce the cling film 12 is increased. In consideration of the above, the preferable tooth height and pitch of the teeth are as follows.

The tooth height of the center large teeth 31 is preferably 1.0 mm to 4.0 mm, more preferably 1.2 mm to 3.5 mm, and further preferably 1.5 mm to 3.0 mm, and the pitch between the center large teeth 31 is preferably 3.0 mm to 9.0 mm, more preferably 4.0 mm to 7.0 mm, and further preferably 4.5 mm to 6.0 mm. The tooth height of the center middle teeth 32 is preferably 1.0 mm to 3.0 mm, and more preferably 1.2 mm to 2.5 mm. The tooth height of the center small teeth 33 is preferably 0.5 mm to 2.5 mm, and more preferably 0.6 mm to 2.0 mm.

The tooth height of the first middle teeth 41 is preferably 0.3 mm to 2.5 mm, and more preferably 0.5 mm to 2.0 mm, and the pitch of the first middle teeth 41 is preferably 1.0 mm to 3.5 mm, and more preferably 1.2 mm to 3.0 mm. The tooth height of the second middle teeth 42 is preferably 0.3 mm to 1.5 mm, and more preferably 0.5 mm to 1.2 mm.

The tooth height of the first end teeth 51 is preferably 1.0 mm to 4.0 mm, more preferably 1.2 mm to 3.5 mm, and further preferably 1.5 mm to 3.0 mm, and the pitch between the first end teeth 51 is preferably 3.0 mm to 9.0 mm, more preferably 4.0 mm to 7.0 mm, and further preferably 4.5 mm to 6.0 mm. The tooth height of the second end teeth 52 is preferably 1.0 mm to 3.0 mm, and more preferably 1.2 mm to 2.5 mm.

The first embodiment has the following advantages.

The roots of the first end teeth 51 on each end portion 50 of the cutter blade 20 are located an the corresponding reference straight line LB, and the first end teeth 51 on each end portion 50 are located to overlap the corresponding first center tooth top straight line L1. When starting to cut the cling film 12 from the center portion 30 of the cutter blade 20, force required for the initial cutting is small since only the center large teeth 31 of the center portion 30 pierce the cling film 12 during the initial cutting. When starting to cut the cling film 12 from one of the end portions 50 of the cutter blade 20, force required for the initial cutting is small since only the first end teeth 51 of the end portion 50 pierce the cling film 12 during the initial cutting. Thus, the cling film 12 is cut by using the cutter blade 20 in a suitable manner in either cases where the teeth located at the center portion 30 of the cutter blade 20 first pierce the cling film 12 or where the teeth located at one of the end portions 50 of the cutter blade 20 first pierce the cling film 12 to start cutting the packing material.

The center large teeth 31 and the first end teeth 51 used to improve the cutting performance as described above are relatively large. This contributes to improvement of the durability of the cutter blade 20.

Since the tooth tops of the first end teeth 51 of each end portion 50 are located on the corresponding first center tooth top straight line L1, the cutter blade 20 has substantially uniform durability along the entire length.

Since cutting of the cling film 12 by the end portions 50 of the cutter blade 20 is performed with not only the first end teeth 51, but also the second end teeth 52, each of which is located between the adjacent pair of first end teeth 51 and has a tooth height that is less than the tooth height of the first end teeth 51, cutting of the cling film 12 by the end portions 50 further smoothly proceeds. This further improves cutting of the cling film 12 by the cutter blade 20.

Since the center small teeth 33 are provided on both left and right ends of the center portion 30 of the cutter blade 20, transition between the cutting of the cling film 12 by the center portion 30 of the cutter blade 20 and the cutting of the cling film 12 by the middle portions 40 of the cutter blade 20 proceeds in a suitable manner. This improves cutting of the cling film 12 by the cutter blade 20.

Second Embodiment

A second embodiment of the present invention will now be described with reference to FIG. 7. The packing container of the second embodiment differs from the packing container 10 of the first embodiment in the shape of the first end teeth 51. Hereinafter, the difference will be described in detail.

Figure 7:
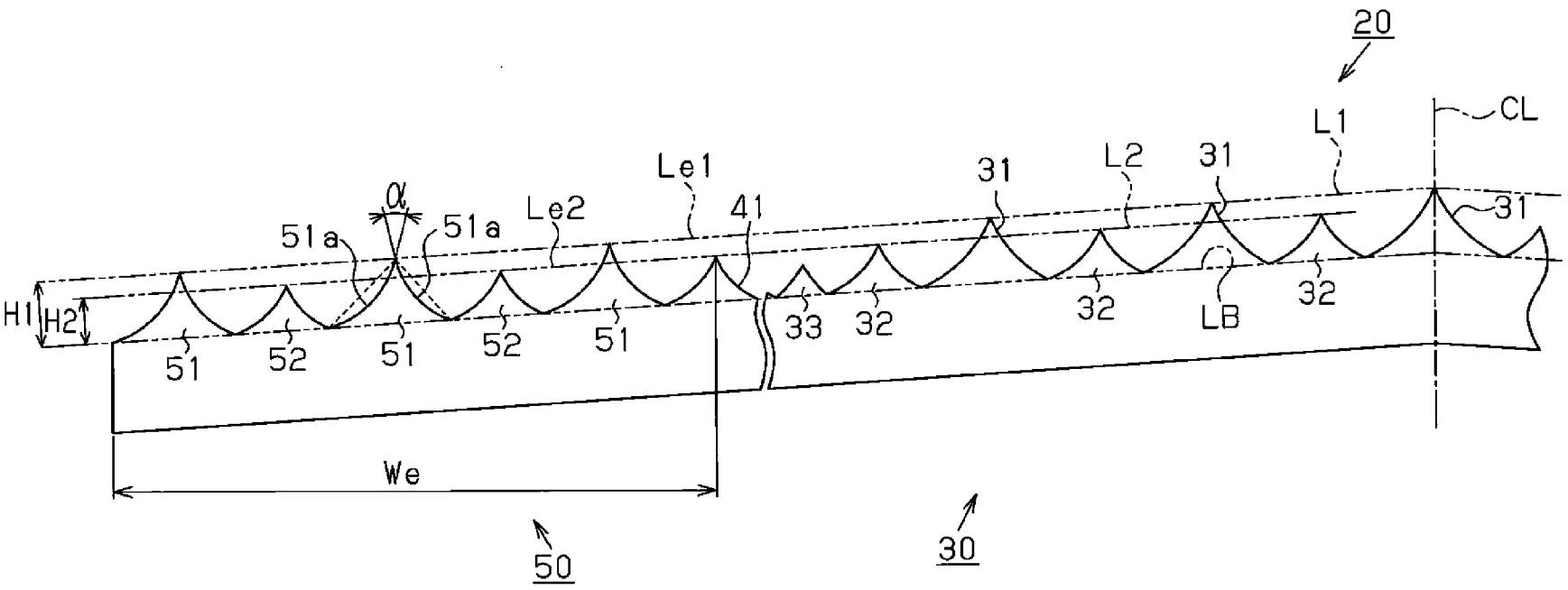
FIG. 7 is a front view illustrating part of a cutter blade according to a second embodiment of the present invention.

As shown in FIG. 7 illustrating the center portion 30 and the end portion 50 located on the left half of the cutter blade 20 of the second embodiment, each of the first end teeth 51 has two arcuate oblique sides 51*a*, which are recessed inward of the first end tooth 51. The first end teeth 51 have the shape similar to the leaves of ginkgo trees, that is, the width of the first end teeth 51 is increased toward the roots. The angle between the tangents of the arcuate oblique sides 51*a* at the tooth top of each first end tooth 51 is referred to as a tooth top angle $\alpha$. The tooth top angle $\alpha$ is an angle suitable for the first end teeth 51 to pierce the cling film 12. If the cling film 12 is made of polyvinylidene chloride, preferably $30° \leq \alpha \leq 5\ 90°$, and more preferably $40° \leq \alpha \leq 70°$. If the tooth top angle $\alpha$ is greater than 90°, the force required to cause the first end teeth 51 to pierce the cling film 12 might be particularly increased. If the tooth top angle $\alpha$ is less than 30°, the durability of the first end teeth 51 might be reduced.

The second embodiment has the following advantages.

Since the two oblique sides 51*a* of each first end tooth 51 are arcuate, the width of the roots of the first end tooth 51 is increased while keeping the tooth top angle $\alpha$ of the first end tooth 51 to be an acute angle appropriate for the piercing into the cling film 12. This contributes to the improvement of the durability of the first end teeth 51. Also, increasing the width of the roots of the first end teeth 51 reduces the number of the first end teeth 51, which reduces the force required to cause the first end teeth 51 to pierce the cling film 12.

Third Embodiment

A third embodiment of the present invention will now be described with reference to FIG. 8. The packing container of the third embodiment differs from the packing container of the first embodiment in the shape of the first end teeth 51. Hereinafter, the difference will be described in detail.

Figure 8:
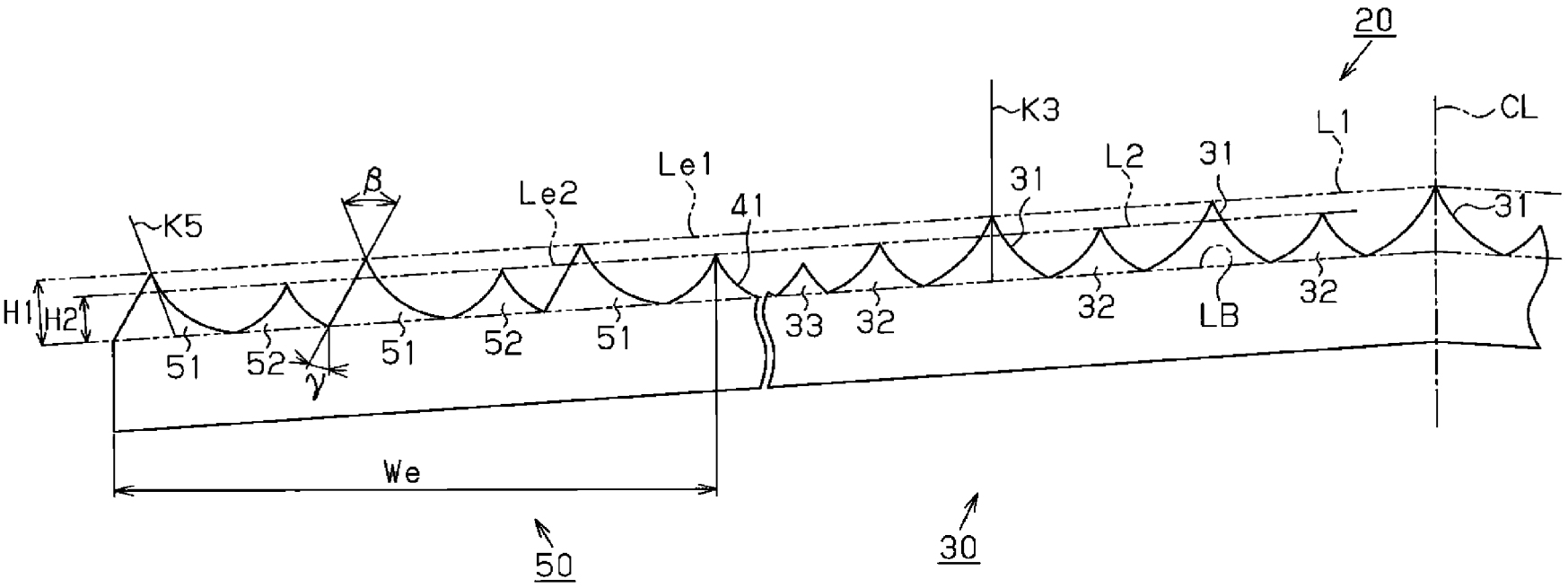
FIG. 8 is a front view illustrating part of a cutter blade according to a third embodiment of the present invention.

As shown in FIG. 8 illustrating the center portion 30 and the end portion 50 located on the left half of the cutter blade 20 of the third embodiment, one of the two oblique sides of each first end tooth 51 located on the outer side is straight, and the other one located on the inner side is arcuate and recessed inward of the first end tooth 51. The half line that extends from the intermediate point between the roots of each tooth on the cutter blade 20 through the tooth top of the tooth is referred to as a tooth top line. A tooth top line K5 of each of the first end teeth 51 differs from tooth top lines of the other teeth on the cutter blade 20, for example, tooth top lines K3 of the center large teeth 31 in that the tooth top line K5 is largely inclined with respect to the center line CL. That is, the first end teeth 51 differ from the other teeth on the cutter blade 20 in that the tooth tops are facing outward. The angle between the tangent of the arcuate oblique side and the straight oblique side at the tooth top of each first end tooth 51 is referred to as a tooth top angle $\beta$. The tooth top angle $\beta$ is an angle suitable for the piercing of the first end teeth 51 into the cling film 12. If the cling film 12 is farmed of polyvinylidene chloride, the tooth top angle $\beta$ is preferably 20° to 60°, and more preferably 20° to 40°. If the tooth top angle $\beta$ is greater than 60°, the force required to cause the first end teeth 51 to pierce the cling film 12 might be particularly increased. If the tooth top angle $\beta$ is less than 20°, the durability of the first end teeth 51 might be reduced.

The angle $\gamma$ between the straight oblique side of each first end tooth 51 and the straight line that extends through the proximal end of the straight oblique side of the first end tooth 51 and is parallel to the center line CL is preferably 2° to 20°. If the angle $\gamma$ is within the above range, the first end teeth 51 function in a particularly suitable manner during the piercing of the first end teeth 51 into the cling film 12 and the following cutting.

The third embodiment has the following advantages.

When cutting the cling film 12 with the cutter blade 20 of the third embodiment by the previously mentioned second cutting method, the first end tooth 51 located on the right end of the cutter blade 20 first contacts and pierces the cling film 12, and the remaining first end teeth 51 located on the right end portion 50 subsequently contact and pierce the cling film 12 in order from the right. The first end teeth 51 piercing the cling film 12 in this manner further deeply pierce the cling film 12 so that cutting of the cling film 12 is started. At this time, the main surface of the cling film 12 (upper surface in FIG. 6) is lifted toward the tooth tops of the first end teeth 51 by lifting the cling film 12 drawn out from the packing container 10 since the tooth tops of the first end teeth 51 located on the right end portion 50 face outward (right side). Thus, the first end teeth 51 further smoothly pierce the cling film 12.

The above illustrated embodiments may be modified as follows.

Figure 9:
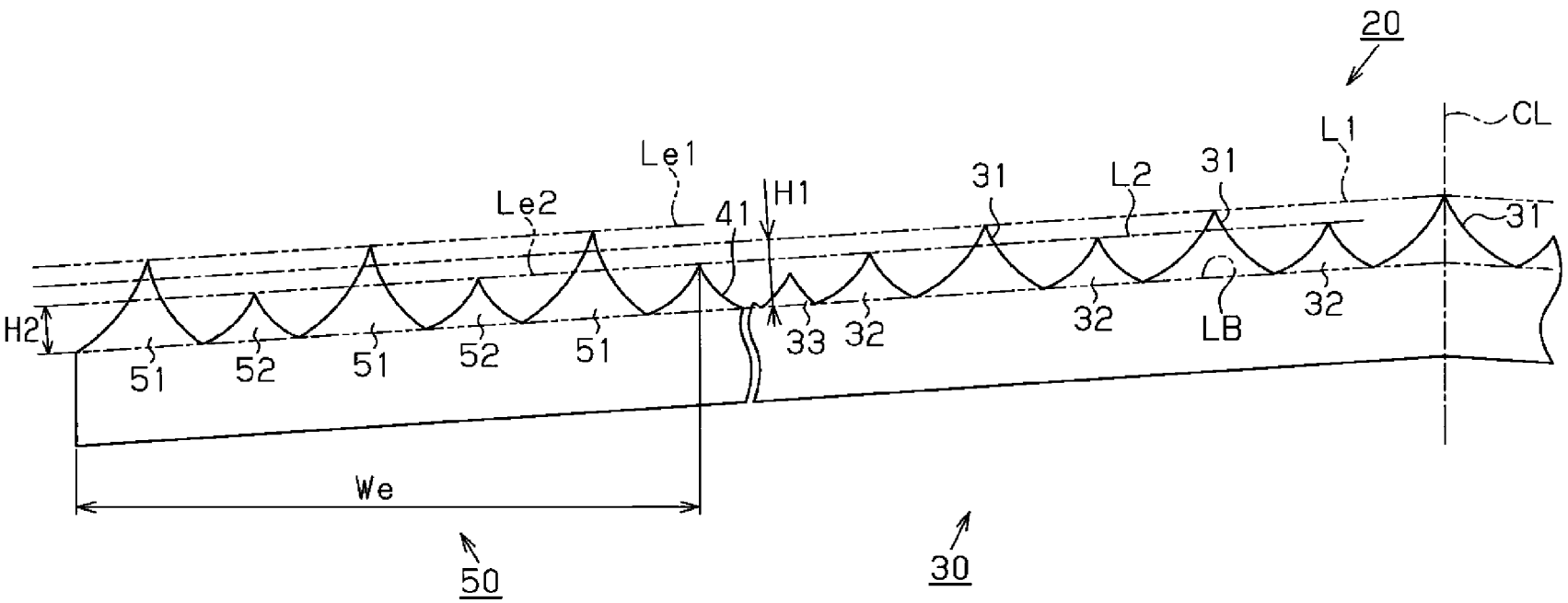
FIG. 9 is a front view illustrating part of a cutter blade according to a modified embodiment of the present invention.

In the above illustrated embodiments, each first end tooth top straight line Le1 is a straight line that is the same as the corresponding first center tooth top straight line L1. However, each first end tooth top straight line Le1 may pass above the tooth tops of the corresponding center large teeth 31 as shown in FIG. 9. That is, the first end teeth 51 of each end portion 50 of the cutter blade 20 may be in any size as long as they are at least located to overlap the corresponding first center tooth top straight line L1.

Figure 10:
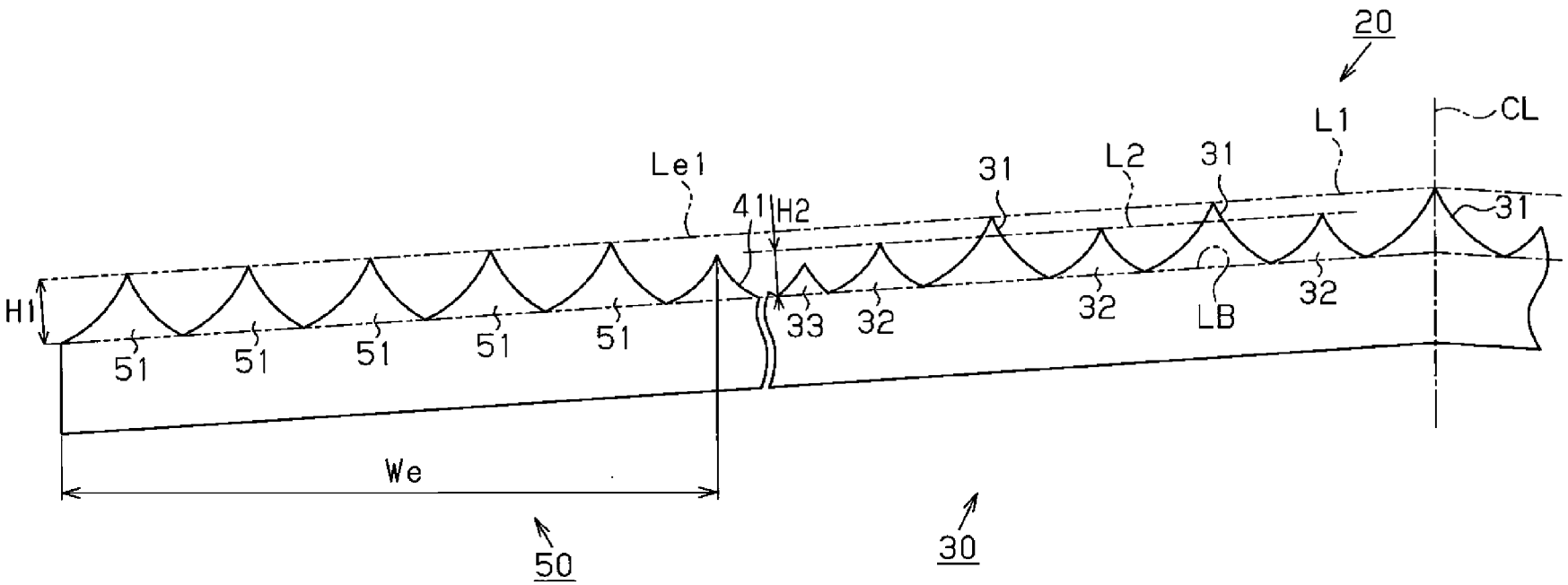
FIG. 10 is a front view illustrating part of a cutter blade according to a further modified embodiment of the present invention.

In the above illustrated embodiments, each end portion 50 of the cutter blade 20 includes the first end teeth 51 and the second end teeth 52. However, each end portion 50 may only include the first end teeth 51 but not the second end teeth 52 as shown in FIG. 10. Each end portion 50 may be formed in any way as long as the end portion 50 includes at least the first end teeth 51.

In the above illustrated embodiments, each middle portion 40 of the cutter blade 20 includes the first middle teeth 41 and the second middle teeth 42. However, each middle portion 40 may only include the first middle teeth 41 but not the second middle teeth 42, or may only include the second middle teeth 42 but not the first middle teeth 41. Each middle portion 40 may be formed in any way as long as the middle portion 40 includes at least the first middle teeth 41.

In the second embodiment, the two oblique sides 51*a* of each first end tooth 51 are arcuate and recessed inward of the first end tooth 51. However, the oblique sides of the teeth other than the first end teeth 51 such as the second end teeth 52 and the center large teeth 31 may be arcuate and recessed inward of the teeth in the same manner. In this case, the width of the roots of the teeth other than the first end teeth 51 is increased while keeping the tooth top angle α of the teeth to an acute angle appropriate for the piercing into the cling film 12.

In the third embodiment, the tooth tops of the second end teeth 52 may face outward in addition to the tooth tops of the first end teeth 51.

In the third embodiment, one of the oblique sides of each first end tooth 51 does not need to be arcuate and recessed inward, but for example, the oblique sides of each first end tooth 51 may both be straight lines.

The packing material that is accommodated in the packing container 10 and cut with the cutter blade 20 may be, for example, aluminum foil or paper instead of the cling film 12.

The invention claimed is:

1. A non-metallic V-shaped cutter blade that is used by being attached to a packing container accommodating rolled packing material to cut the packing material, the cutter blade comprising a center portion including a vertex of the V, a pair of end portions each including one of ends of the V, and a pair of middle portions each located between one of the end portions and the center portion, wherein:

the center portion includes a plurality of first center teeth and a plurality of second center teeth on both sides of the vertex, the second center teeth have a tooth height less than a tooth height of the first center teeth, all the first center teeth are arranged such that a distance between adjacent first center teeth is constant for all the first center teeth on both sides of the vertex, one of the first center teeth located at a center is located at the vertex of the V, the second center teeth are each located between adjacent two of the first center teeth, a first tooth top line connects tooth tops of the first center teeth, a second tooth top line connects tooth tops of the second center teeth, and a tooth root line connects roots of the first center teeth and roots of the second center teeth, the first tooth top line, the second tooth top line and the tooth root line are parallel to one another, and the second tooth top line is located between the first tooth top line and the tooth root line, wherein:

the middle portions each include a plurality of middle teeth, and tooth tops of the middle teeth are located on the second tooth top line or between the second tooth top line and the tooth root line, and wherein:

the end portions each include a plurality of first end teeth, the first end teeth are located to overlap the first tooth top line, and the first end teeth each include at least one arcuate oblique side that is recessed inward of the first end tooth.

2. The cutter blade according to claim 1, wherein tooth tops of the first end teeth are located on the first tooth top line.

3. The cutter blade according to claim 1, wherein the tooth top of each of the first end teeth faces outward in a longitudinal direction of the packing container.

4. The cutter blade according to claim 1, wherein each end portion further includes second end teeth each located between adjacent two of the first end teeth, and the second end teeth have a tooth height less than that of the first end teeth.

5. The cutter blade according to claim 1, wherein the center portion includes third center teeth located in the vicinity of the middle portions, roots of the third center teeth are located on the tooth root line, and tooth tops of the third center teeth are located between the second tooth top line and the tooth root line.

6. A packing container for accommodating rolled packing material, the packing container comprising the cutter blade according to claim 1 to cut the packing material.

* * * * *

UNITED STATES PATENT AND TRADEMARK OFFICE

CERTIFICATE OF CORRECTION

PATENT NO. : 8,727,194 B2
APPLICATION NO. : 12/740322
DATED : May 20, 2014
INVENTOR(S) : Hideoka et al.

It is certified that error appears in the above-identified patent and that said Letters Patent is hereby corrected as shown below:

On the Title Page

Item (75), Inventors, change "Makoto Unino" to --Makoto Unno--

Signed and Sealed this
Twenty-sixth Day of August, 2014

Michelle K. Lee

Michelle K. Lee
*Deputy Director of the United States Patent and Trademark Office*